US006213828B1

(12) United States Patent
Tsumiyama et al.

(10) Patent No.: US 6,213,828 B1
(45) Date of Patent: Apr. 10, 2001

(54) EXHAUST PIPE OF PERSONAL WATERCRAFT AND CONNECTING STRUCTURE THEREOF

(75) Inventors: Yoshinori Tsumiyama, Miki; Masaki Ito, Ono, both of (JP)

(73) Assignee: Kawasaki Jukosyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 09/323,299

(22) Filed: Jun. 1, 1999

(30) Foreign Application Priority Data

Jun. 3, 1998 (JP) ..... 10-154460
Jun. 3, 1998 (JP) ..... 10-154466

(51) Int. Cl.[7] ..... B63H 21/32
(52) U.S. Cl. ..... 440/89
(58) Field of Search ..... 440/88, 89; 114/55.5

(56) References Cited

U.S. PATENT DOCUMENTS 4,586,908 * 5/1986 Schlichthorst ..... 440/89
4,600,394 * 7/1986 Dritz ..... 440/38
4,773,215 * 9/1988 Winberg et al. ..... 60/324
5,046,977 * 9/1991 Rodskier ..... 440/89
5,505,644 * 4/1996 Ousley, II et al. ..... 440/89

FOREIGN PATENT DOCUMENTS 534100 5/1993 (JP) .
739758 9/1995 (JP) .

* cited by examiner

*Primary Examiner*—S. Joseph Morano
*Assistant Examiner*—Andrew Wright

(57) ABSTRACT

An exhaust pipe suitable for a personal watercraft which can reduce exhaust noises, prevent a transom board from being made dirty by an exhaust gas and avoid exposing a rider trying to get onto a deck to the exhaust gas stream directly, the exhaust pipe being provided above a water line of a transom board for discharging an exhaust gas behind the personal watercraft, the exhaust pipe projects from the transom board rearward and has at least a rear portion curved downward. Consequently, an opening face provided on a rear end of the exhaust pipe is oriented obliquely rearward with respect to a water surface as seen from a side of the personal watercraft.

13 Claims, 5 Drawing Sheets

EXHAUST PIPE OF PERSONAL WATERCRAFT AND CONNECTING STRUCTURE THEREOF

BACKGROUND OF THE INVENTION

1. Field of the Invention

The invention relates to a personal watercraft (also called a PWC) that planes along the surface of the water, and more particularly to an exhaust pipe of the personal watercraft and a connecting structure thereof.

2. Description of the Related Art

Personal watercraft have been gaining popularity in recent years for recreational and sports purposes. Generally, the personal watercraft is constructed to thrust forward by increasing the pressure of water drawn through a water intake provided on a bottom of the hull or body of the watercraft, by a propulsion pump, and ejecting the water rearward from the body.

In personal watercraft the exhaust pipe is conventionally provided on a transom board of the body to discharge an exhaust gas rearward of the transom board from an exhaust port of an engine mounted in the body (Japanese Utility Model Publication No. Hei 7-39758).

Furthermore, some personal watercraft are configured so that a rear end of the exhaust pipe is provided with a valve-shaped shut-off member made of rubber which can be opened and closed by opening force born of an exhaust gas pressure in order to reduce exhaust noises (Japanese Unexamined Utility Model Publication No. Hei 5-34100).

In use of personal watercraft, generally, a rider in the water gets on a deck from a rear-end (transom board side) of the body If the above-mentioned shut-off member is provided, the rider is not directly exposed to the exhaust gas stream even when the engine is kept in an operating state.

However, there is a drawback that the exhaust gas pressure in the exhaust pipe is increased by the shut-off member to lower an output of the engine. Also, in a state in which the output of the engine is high, the exhaust gas hitting against the shut-off member is returned to the transom board of the body. Consequently, the exhaust gas makes an external wall of the transom board dirty.

Exhaust pipelines of some personal watercraft are configured so that plural pipe members are connected to each other along the route of the exhaust pipelines. In a connecting portion, generally, a flange is formed on each of the ends of the pipe members to be connected to each other. A seal member such as a packing is provided between the two flanges to be connected to each other. Bolts are inserted through holes provided in corresponding positions of a peripheral portion of each of the two flanges, and fastened, thereby performing the connection with a seal function when the two flanges are pressed against each other. With such a connecting structure of the exhaust pipe members, the mutual alignment (centering) of connecting pipe members, that is to say, the alignment for causing axial centers of respective inner holes (passages) of the pipe members to correspond to each other, is mainly performed in connection with the bolts being inserted through the holes in the respective flanges. However, the size of each hole is generally greater than an outside diameter of the bolt inserted through it. Therefore, the alignment cannot be carried out with precision.

In addition, in a case where the exhaust pipeline connected on a rear flow side of the connecting portion contains one or more pipe members that are bent, a back pressure is generated in the connecting portion. Accordingly, the seal member mentioned above is indispensable in the connecting portion for obtaining a good seal. For this reason, a component parts count of the connecting portion is increased. Furthermore, in assembly of the exhaust pipeline it is necessary to perform complicated work using both hands and skill in such a manner that the bolts are inserted through the holes in the flanges, with the seal member to be held between the flanges.

Also, in order to obtain a good seal, it is necessary to enhance the rigidity of the flanges, so as to uniformly compress the seal member provided between the flanges at the periphery of the inner conduit through which the exhaust gas passes. As a result, the flange has been bulky and heavy. This connecting structure is not desirable for personal watercraft, which generally have only a small space for the exhaust pipeline, and requires a light weight. (Japanese Unexamined Utility Model Publication No. Hei 3-128598 discloses related art for such a connecting structure).

SUMMARY OF THE INVENTION

In order to solve the above-mentioned problems, it is an object of the invention to provide an exhaust pipe suitable for a personal watercraft capable of reducing noise from exhaust pipe discharge, and also mitigation of the tendency of an exhaust gas stream to make the transom board dirty, without exposing a rider trying to get on a deck from rear-end of the personal watercraft body to the exhaust gas stream directly.

It is another object of the invention to provide a connecting structure of an exhaust pipe suitable for personal watercraft, which is reliable, small-sized and can be easily assembled.

The invention provides an exhaust pipe of a personal watercraft having an outlet opening formed on a rear end thereof. The outlet opening is positioned above a water surface and behind a transom board at least during planing to discharge an exhaust gas behind the personal watercraft. The exhaust pipe projects rearwardly from the transom board, and at least a rear portion of a projected portion is curved obliquely downward. An opening face of the outlet opening provided on the rear end of the exhaust pipe is oriented obliquely rearward with respect to the water surface as seen from a side of the personal watercraft. In a more detailed aspect, the opening face of the outlet opening of the exhaust pipe is turned obliquely rearward with respect to an extension line extended substantially rearward from the transom board over a planing surface of a bottom of a hull as seen from the side of the watercraft.

In an exhaust pipe of a personal watercraft according to the invention, the exhaust gas discharged from the outlet opening of the exhaust pipe during planing is not caught up in an air vortex flow generated behind the transom board of the body due to exhaust gas stream speed and direction. Accordingly , the exhaust gas hits against the water surface behind the transom board to flow rearward. Consequently, most of the exhaust gas remains behind the watercraft as it moves away. Therefore, the transom board is made less dirty by the exhaust gas. Further, exhaust noise hits against the water surface and a spray of water generated behind the body so that the exhaust noises are damped and absorbed. Consequently, exhaust noise can be reduced. In particular, since a high frequency range portion of the exhaust noise tends to travel in a straight line directed as the exhaust gas stream, a great deal of the high frequency range portion of the exhaust noises are absorbed into the spray of water and into the water surface, and do not carry far from the personal watercraft.

Also, when a rider in the water tries to get on a deck of the personal watercraft from the rear (transom board side), the personal watercraft is inclined rearwardly by rider's weight, so that the opening face of the exhaust pipe sinks in the water, and is pointed in a direction obliquely downward in the water. Therefore, the rider is less exposed to the direct exhaust gas stream when getting onto the deck of the personal watercraft.

As mentioned, the rear portion of the exhaust pipe is curved obliquely downward, and the opening face is oriented obliquely to the water surface as seen from the side of the watercraft. Therefore, by properly changing a radius of curvature, and/or the distance projection of the exhaust pipe from the transom board, and/or the height from the water surface to the rear end of the exhaust pipe, the exhaust pipe configuration can be optimized. In addition, the structure is preferable in that the exhaust gas can smoothly be discharged with less pressure loss. An aesthetic aspect of the design is also improved. In addition to the above-mentioned structure, a rear end portion of the exhaust pipe may be obliquely cut. If the opening face is turned obliquely downward to the water surface to form an angle ranging from about 10 degrees to about 60 degrees with respect to the water surface as seen from the side, the above-mentioned functions and effects of the invention can be obtained. Furthermore, if the opening face is turned obliquely downward to the water surface to form an angle ranging from about 25 degrees to about 45 degrees with respect to the water surface as seen from the side, high frequency exhaust noises can be reduced, and the transom board is not made as dirty due to the relationship of the resulting exhaust stream and the water surface level with a planing speed of the personal watercraft. Thus, the above-mentioned structure is preferred.

If the opening face is turned obliquely downward to the water surface in such a manner that a projected area of the opening face of the outlet opening onto a vertical virtual plane seen from a rear side of the personal watercraft is about ½ of the cross-sectional area of the opening face of the outlet opening at the rear portion of the exhaust pipe, it is possible to effectively reduce the higher frequency exhaust noises which are projected directly rearward by the noise insulating effect of a wall surface of the exhaust pipe. In the above-mentioned structure, particularly, if a distance between an upper end of the opening face and the water surface is almost equal to a diameter of the opening face, better noise reduction effects can be obtained. It is also preferable that a height from a lower end of the opening face to the water surface should be substantially equal to a distance between the transom board and the lower end of the opening face.

In the above-mentioned structure, in a case where the exhaust pipe is provided in a position deviated from a center line of the body of the watercraft toward one of sides, the opening face is also inclined toward that side as seen from a rear side of the personal watercraft. An inclination angle ranges from about 5 degrees to about 35 degrees. Exhaust gas is discharged from the outlet opening toward a side behind the body at a predetermined exhaust speed. The structure is particularly excellent in that the transom board of the body is made less dirty and a rider in the water is not directly exposed to the exhaust gas stream when getting on the deck from the center of the transom board (back) side of the body of the PWC.

Furthermore, the invention provides a connecting structure of the exhaust pipe wherein a flange is provided on a front end of the above-mentioned exhaust pipe. A second exhaust pipe is provided for leading an exhaust gas discharged from an engine to a transom board. A flange is provided on a rear end of the second exhaust pipe for fixing the second exhaust pipe to the transom board and for being connected to the flange of the exhaust pipe. The flanges have connecting through holes formed correspondingly for connecting the flanges to each other. An annular projected portion is provided on an end face of one of the flanges for surrounding an exhaust gas passage(hole) in a central portion. An annular groove is formed on an end face of the other flange for surrounding an exhaust gas passage(hole) in a central portion to house the projected portion therein. The flange of the second exhaust pipe and the flange of the exhaust pipe are connected by a fastening means extending through each of the connecting through holes in such a manner that the annular projected portion is housed in the annular groove. When the fastening means are fixed and the flanges are joined to each other by the fastening means, the connection is performed.

With such a structure, the flanges of the exhaust pipe and the second exhaust pipe to be connected to each other are joined together in a state in which the annular projected portion formed on the end face of one of the flanges is housed in the annular groove formed on the end face of the other flange. They are fastened with the fastening means, such as bolts which are provided in the fastening through holes of the flanges. Consequently, it is easy to join the exhaust pipes with the two exhaust pipes aligned in a strict sense. That is to say, the exhaust gas passages (holes) of the exhaust pipe and the second exhaust pipe are aligned in a strict sense.

In addition, the joined faces (end faces) of the two flanges make a labyrinth seal structure by virtue of the annular projected portion and the annular groove. Therefore, the joined faces have a labyrinth-sealed connection. For this reason, even if the above-mentioned exhaust pipe is bent and raises a back pressure in the connecting portion, it is possible to obtain a connecting structure which is simple and small-sized and has an excellent seal function. In addition, with this configuration it is not always necessary to obtain the seal effect by providing and compressing a seal member. Therefore, the rigidity of the flange may be reduced. As a result, the connecting portion can be small and lightweight.

For at least these reasons, the above-mentioned connecting structure is preferable for the exhaust pipeline of personal watercraft, which have limited space for the exhaust pipe line and require a light weight. In addition, the number of parts can be reduced, and excellent assembling properties can be obtained, while at the same time the structure can also be simplified.

In the above-mentioned structure, if the exhaust pipe or the second exhaust pipe is formed of an elastic material, and a connecting portion of the flange of the pipe which is formed of the elastic material is deformed to achieve a seal function in a state in which the connection is completed, both an elastic compression seal effect and a labyrinth seal effect can be obtained. Also, in such a case, a portion to be deformed is limited to a minimum, but the seal effect can still be obtained. Therefore, it is a matter of course that the rigidity of the flange does not need to be higher than in the prior art.

In the above-mentioned structure, a back face side of the flange of the second exhaust pipe is fixed to an external wall of the transom board in a watertight manner. The flange of the exhaust pipe is fixed to a face of the flange of the second exhaust pipe through a fixing cover for covering an outer periphery of the flanges. The outer periphery of the flange of the exhaust pipe, and that of the second exhaust pipe, are covered and positioned by means of installing the fixing cover over the outer periphery of the flanges. Also, with respect to the aesthetic considerations, the structure is preferred for personal watercraft which require sporting appearance. It is preferable that the flange is non-circular as seen from a back of the watercraft (as seen in a longitudinal direction of the pipe). The reason is that the exhaust pipe can easily be positioned in the circumferential direction by visual observation. Thus, the connection can be performed in a state in which the positioning in the circumferential direction has been more precisely carried out.

These objects, as well as other objects, features, and advantages of the invention will become more apparent to those skilled in the art from the following description, with reference to the accompanying drawings and the appended claims.

DETAILED DESCRIPTION OF THE INVENTION

An exhaust pipe of a personal watercraft according to an embodiment of the invention will be described with reference to the drawings.

Figure 1:
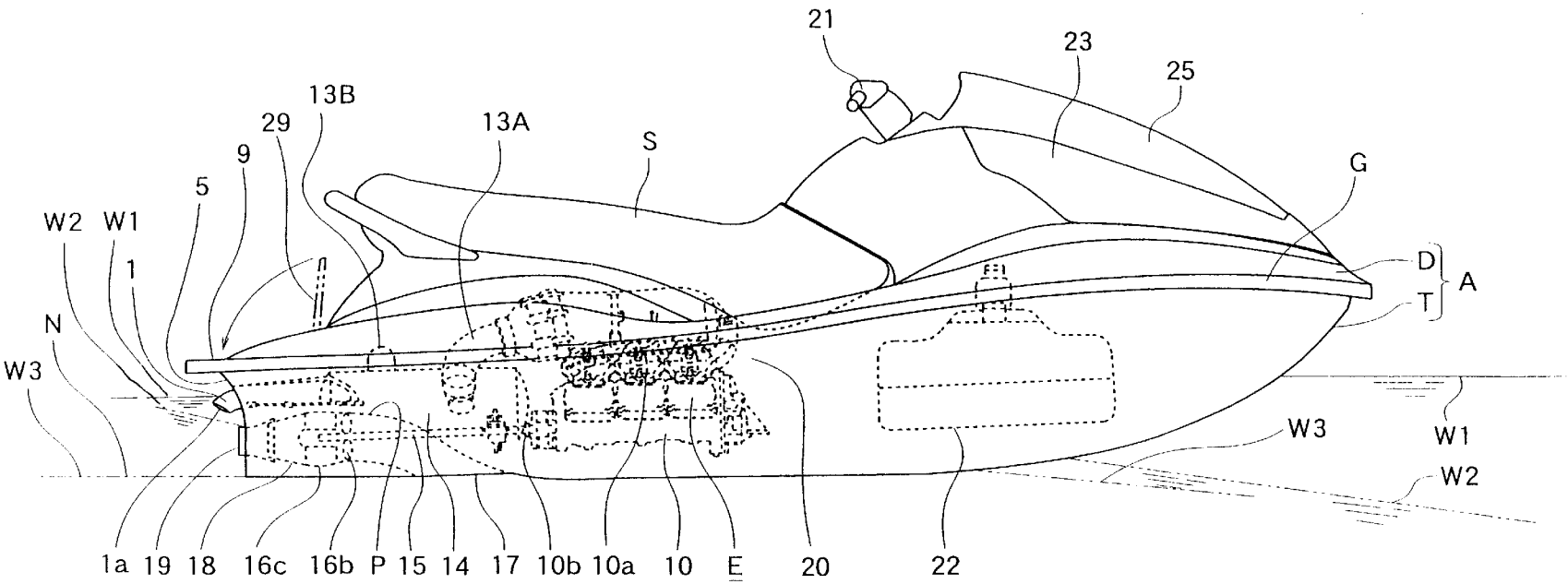
FIG. 1 is a side view showing the personal watercraft having an exhaust pipe and a connecting structure thereof according to an embodiment of the invention.
Figure 2:
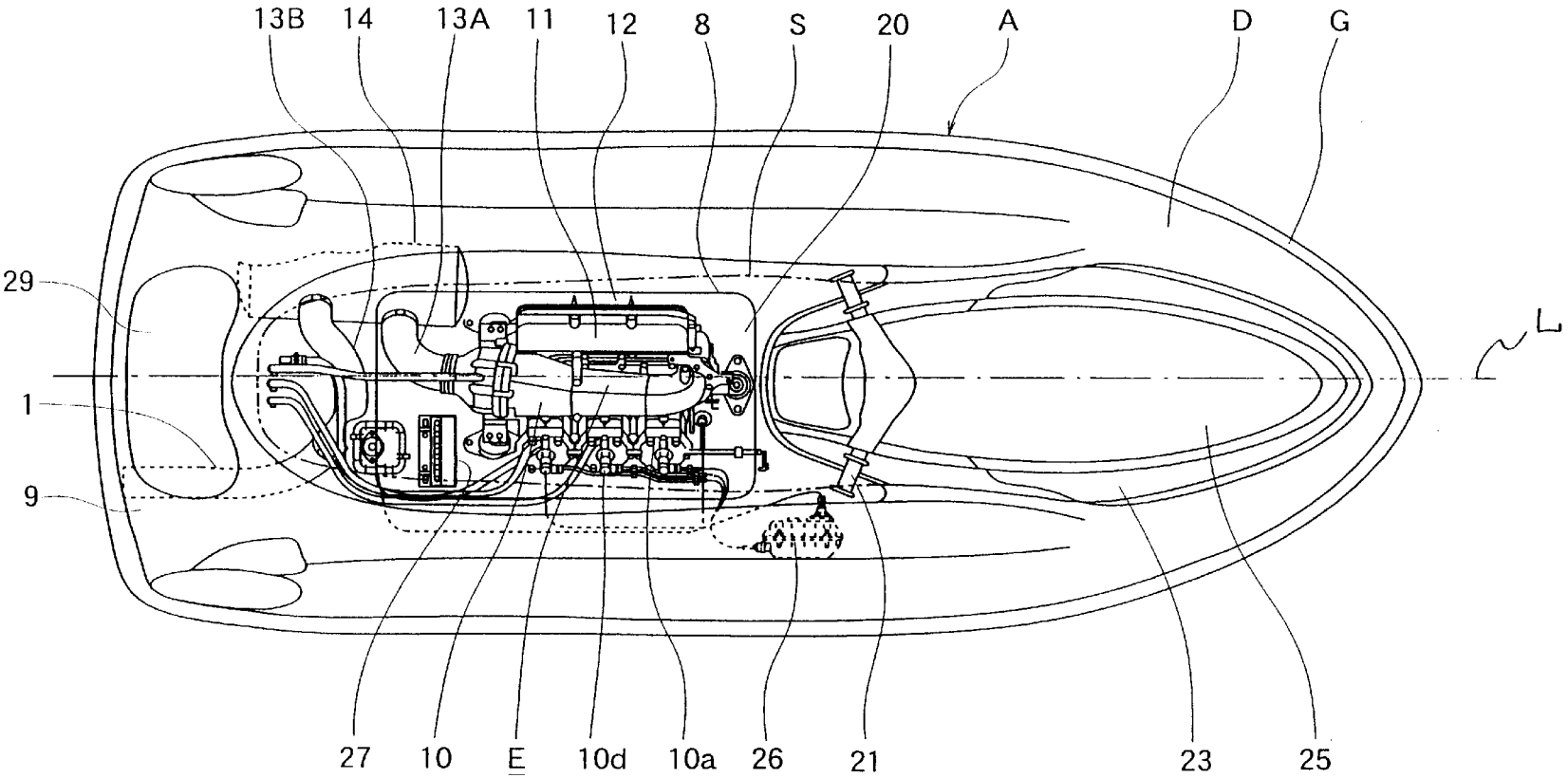
FIG. 2 is a plan view illustrating the personal watercraft shown in FIG. 1, a seat shown in a two-dotted dashed line being removed.

In FIGS. 1 and 2, A denotes a body of the personal watercraft. The body A comprises a hull T and a deck D covering an upper side of the hull T. A connecting line for connecting the hull T and the deck D over the entire periphery thereof is referred to as a gunwale line G. In the present embodiment, the gunwale line G is positioned above a water line W1 of the personal watercraft, which is a water line (water surface) obtained when the personal watercraft is stopped.

Figure 3:
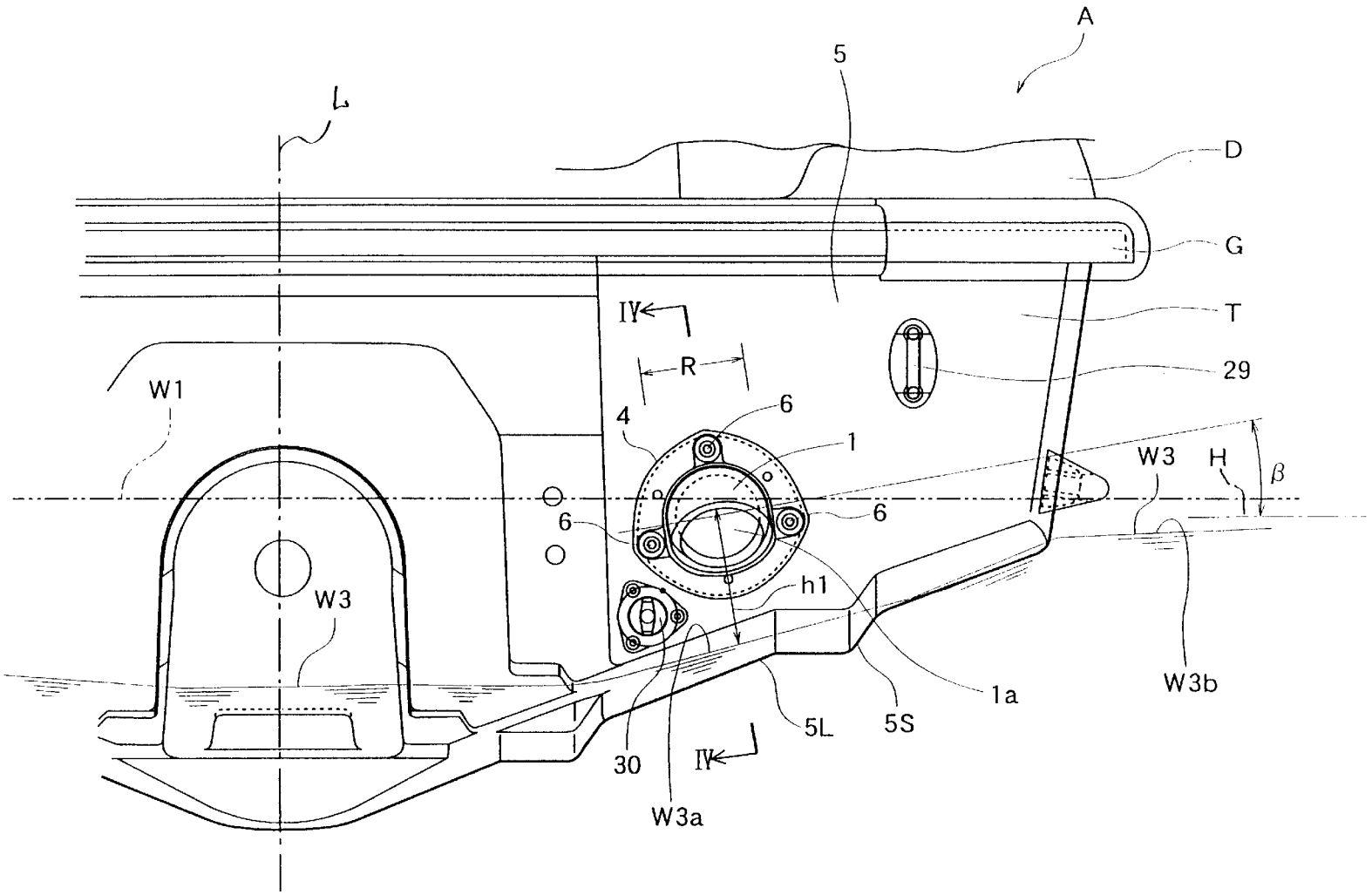
FIG. 3 is an enlarged rear view showing a principal portion of the exhaust pipe seen from a rear side of the personal watercraft shown in FIG. 1.

An outlet opening of an exhaust pipe 1 is provided below the water line (water surface) W1 of a transom board 5 of the body A and provided above a water line (water surface) W2 obtained during acceleration (see the water surface W2 obtained during the acceleration which is shown in a two-dotted dashed line in FIG. 1) and a water line (water surface) W3 obtained during planing (see the water surface W3 obtained during the planing in a steady state which is shown in a two-dotted dashed line in FIG. 1). With reference to FIG. 3, the exhaust pipe 1 is provided in a hull portion of the body and is offset (deviated) from a centerline L of the personal watercraft toward one of sides as shown in FIGS. 2 and 3.

Figure 4:
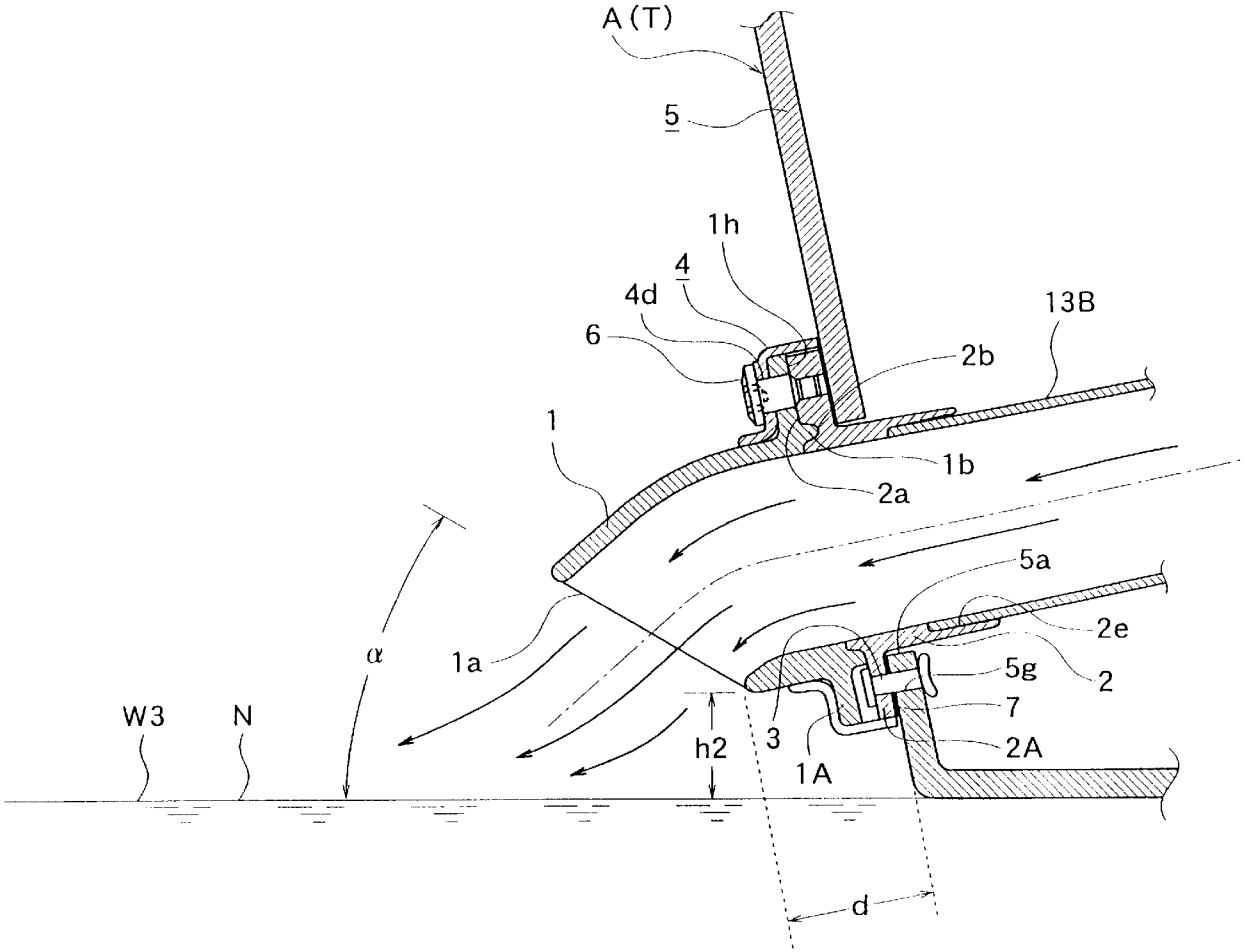
FIG. 4 is a sectional view showing the exhaust pipe taken along the line IV—IV in FIG. 3.

As shown in FIG. 4, the exhaust pipe 1 is projected from the transom board 5 rearward in a longitudinal direction (corresponding to the longitudinal direction of the personal watercraft) and is curved in such a manner that a rear portion of the projected exhaust pipe 1 is bent obliquely downward in a central portion thereof.

In the planing condition in the steady state, as shown in FIG. 4, an opening face 1*a* of the outlet opening of the exhaust pipe 1 is constituted to form an angle of about 30 degrees (see an angle a in FIG. 4) in a longitudinal direction (a planing direction) with respect to the water surface W3, that is, a virtual extension line N which is substantially extended from the transom board 5 toward a rearward over a planing surface of a bottom of the hull. More specifically, the opening face 1*a* is constituted to be turned obliquely rearward at an angle of about 30 degrees with the water surface W3 (the virtual extension line N) behind the personal watercraft. As shown in FIG. 3, the opening face 1*a* is also inclined at an angle of about 10 degrees (see an inclination angle β in FIG. 3) with a horizontal plane H seen from the rear side of the personal watercraft toward a side end of the body A which is closer to the exhaust pipe 1. The outside inclination angle β (see FIG. 3) causes the exhaust gas to directly come in contact with a water surface W3*a*, rearward of the personal watercraft in accordance with the illustrated embodiment, at an almost right angle seen from the rear side of the body A. The water surface W3*a* almost corresponds to a line 5L on a lower end of the transom board 5.

With reference to FIG. 4, as mentioned above it is desirable that the inclination angle α of the opening face 1*a* with respect to the water surface W3, seen from a side of the personal watercraft, should be about 30 degrees. However, it has become apparent from experiments that almost the same functions and effects, which will be described below, can be obtained with an inclination angle α of about 25 degrees to about 45 degrees. With such a structure, particularly as the body A is inclined rearward (in such a manner that a bow is raised and a stern sinks) at the time of acceleration making loud exhaust noises, the opening face 1*a* almost faces to the water surface W2. Therefore, the exhaust noises can effectively be reduced.

With reference to FIG. 3, if a projected sectional area of the opening face 1*a* of the exhaust pipe 1 onto a vertical virtual plane seen from the rear side is about ½ of the section area of the opening face 1*a* (a cross-sectional area of the exhaust pipe 1 at the face 1*a*) as seen from the rear side illustrated in FIG. 3, more effects of reducing exhaust noises having a high frequency can be obtained by the noise insulating effect of a wall surface of the exhaust pipe.

With reference to FIG. 4, during the planing in the steady state, however, the functions and effects of preventing the transom board from becoming dirty by the exhaust gas and of reducing the exhaust noises is realized by turning the opening face 1*a* downward within a range of 10 to 60 degrees with respect to the water surface W3 as seen from a side.

With reference to FIG. 3, as mentioned above it is desirable that the inclination angle β of the opening face 1*a* should be about 10 degrees in the personal watercraft having the lower end line 5L of the transom board 5. Whenever the inclination angle β is about 5 to 35 degrees, the functions and effects can be obtained by inclining the opening face 1*a* toward the outside. The inclination angle β formed toward the outside is chosen for each hull, corresponding to an inclination angle of the lower end line 5L of the transom board 5.

While the exhaust pipe 1 is made of slightly hard rubber in the embodiment, it may be made of soft rubber. Depending on circumstances, the exhaust pipe 1 may be made of plastic such as ABS, other resins, or metal such as aluminum, stainless or the like.

As shown in FIG. 3, in the embodiment, a diameter R of the opening face 1*a* of the exhaust pipe 1 is almost equal to a distance h1 between an upper end of the opening face 1*a* of the exhaust pipe 1 and the water surface W3. Such a structure can have the functions and effects of effectively causing the exhaust gas to remain on the water surface behind the watercraft as it travels away, and of effectively causing a spray of water formed behind the body to absorb exhaust noises without the rise of back pressure in the exhaust pipe line. More specifically, in a case where the distance hl between the upper end and the water surface is greater than the diameter R of the opening face 1*a*, the exhaust gas is caught up in a vortex flow formed by running (planing) in the vicinity of the transom board 5 so that the transom board 5 is made dirty and the effect of reducing the exhaust noises is deteriorated. On the other hand, if the distance h1 is smaller than the diameter R, the exhaust pressure of the exhaust pipe 1 is increased so that the output of the engine is lowered.

Referring to a distance d between the transom board 5 and the opening face 1*a*, as shown in FIG. 4, it is preferable that a height h2 from the water surface W3 to the lower end of the opening face 1*a* should generally be equal to the distance d between the transom board 5 and the lower end of the opening face 1*a* or that the distance d should be a little greater than the height h2. More specifically, if the distance d is much greater than the height h2, that is, the exhaust pipe 1 is greatly projected from the transom board 5 of the body A, the exhaust pipe 1 is obstructive when a rider in the water tries to get on the deck of the personal watercraft and is also obstructive when the personal watercraft is to be mounted on or got down from a trailer or the like. On the other hand, if the distance d is smaller than the height h2, the exhaust gas is caught up in an air vortex flow behind the transom board 5 caused by the transom board 5 so that the transom board 5 is made dirty.

Figure 5:
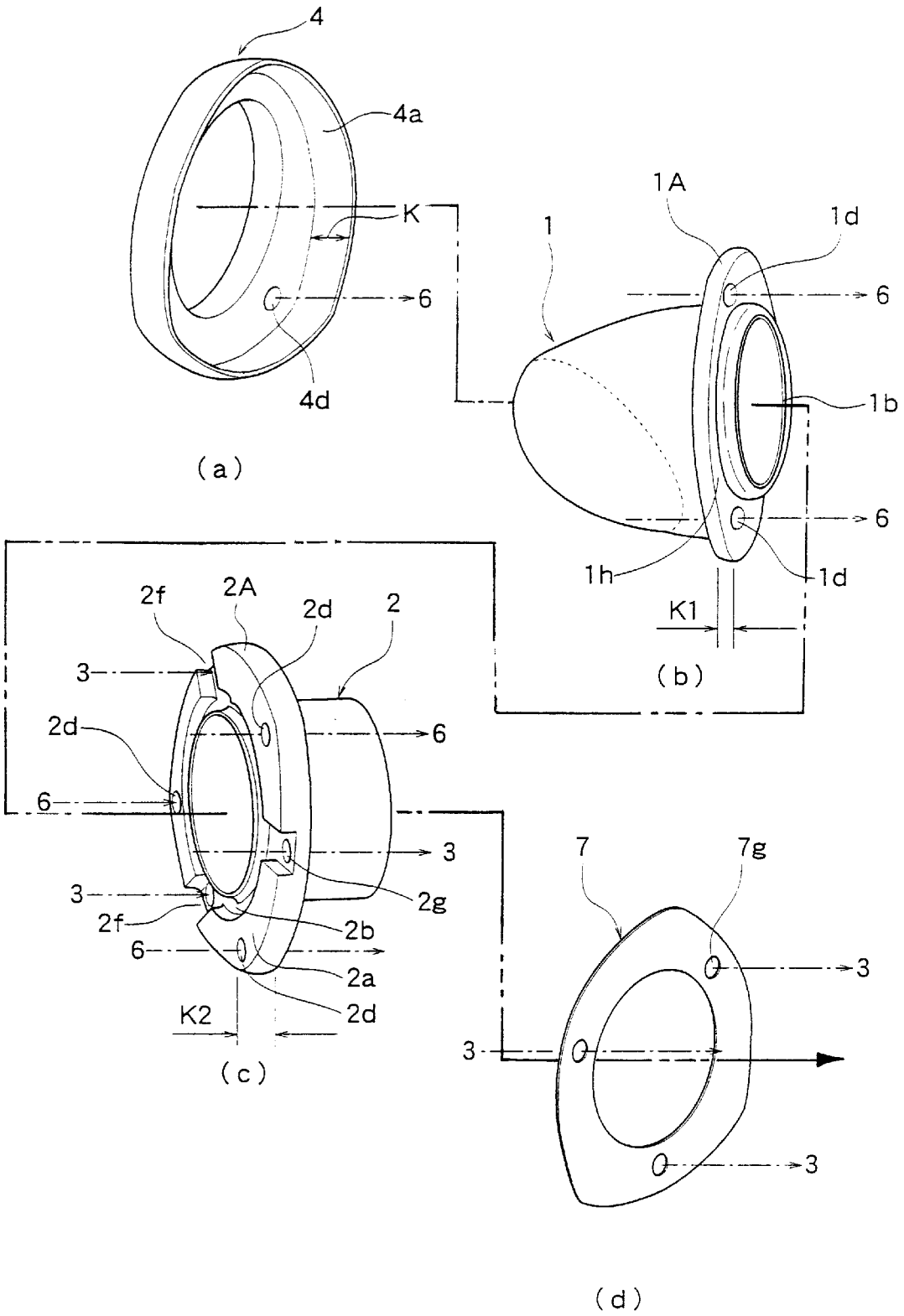
FIG. 5 is a perspective view showing components of a connecting structure of the exhaust pipe, FIG. 5(*a*) being a perspective view showing a fixing cover, FIG. 5(*b*) being a perspective view showing the exhaust pipe, FIG. 5(*c*) being a perspective view showing a sleeve(second exhaust pipe) and FIG. 5(*d*) being a perspective view showing a packing.

In the illustrated embodiment, the exhaust pipe 1 is fixed to the body A of the watercraft in the following manner. As shown in FIGS. 4 and 5, a flange 1A is formed on a front end of the exhaust pipe 1 (on the body side), and a projected portion 1*b* which is annular and has an almost inverted U-shaped (semicircular) section is formed on an end face 1*h* of the flange 1A on the connecting side concentrically with an inner hole to act as an exhaust gas passage.

A sleeve 2 being formed a rear end portion of the second exhaust pipe, which lead the exhaust gas to the transom board 5 side of the body from the engine, to abut on the flange 1A of the exhaust pipe 1 is fixed to the transom board 5, and a groove (an annular groove) 2*b* which has a U-shaped section and is annular is formed on an end face 2*a* of the sleeve 2 on the connecting side concentrically with an inner hole to act as an exhaust gas passage. In detail, the sleeve 2 is made of aluminum and the exhaust pipe 1 is made of hard rubber in the illustrated embodiment. The size of the section of the annular groove 2*b* of the sleeve 2 is slightly smaller than that of the section of the inverted U-shaped projected portion 1*b* of the exhaust pipe 1. As shown in FIG. 4, if two flanges 1A and 2A are joined together, the projected portion 1*b* is compressed (pressed) and housed in the annular groove 2*b*.

The two flanges 1A and 2A have non-circular shapes seen from a front as shown in FIGS. 3 and 5, and have almost triphyllous (almost triangular) shapes. Fixing, or connecting, through holes 1*d* and 2*d* for pressing and connecting the two flanges 1A and 2A to each other are formed corresponding to upper side and both side portions of the two flanges 1A and 2A, respectively. The non-circular shape serves as an aid to perform positioning in a circumferential direction. Accordingly, it is possible to employ various shapes such as a shape obtained by removing (cutting off) a part of a circular shape, an elliptical shape, a triangular shape and a square shape in addition to the triphyllous shape. A notch portion 2*f* to act as a relief portion (relief space) of a rivet 3 which will be described below is formed in three portions of an outer peripheral portion of the flange 2A so as to be positioned intermediate each through hole 2*d* as shown in FIG. 5(*c*). A fixing through hole 2*g* for fixation to the transom board 5 is formed in the notch portion 2*f*.

As shown in FIG. 4, furthermore, a large diameter portion 2*e* for receiving a tip of an exhaust tube 13B extended from an engine E (see FIGS. 1 and 2) is formed on an inner surface (inner peripheral surface) at an end of the sleeve 2 on the inside of the body (a right side portion in FIG. 4). In the illustrated embodiment, the exhaust tube 13B is made of aluminum.

As shown in FIGS. 4 and 5, the two flanges 1A and 2A are configured to be covered with a hat-shaped fixing cover 4 having a rising portion 4*a* on the rear surface and outer peripheral surface side of the flange 1A. The fixing cover 4 is inserted into the rear end side of the exhaust pipe 1 (the left side (the exhaust surface 1*a* side) in FIG. 4). Accordingly, the outer peripheral shape of the fixing cover 4 seen from a front side is similar to outer peripheral shapes of the flanges 1A and 2A seen from a front side. In other words, the dimension of an inner peripheral surface of the fixing cover 4 which is seen from the front side is slightly greater than the dimensions of outer peripheral surfaces of the flanges 1A and 2A seen from the front side. The rising portion 4*a* has a dimension (depth) K which is slightly smaller than the sum of thicknesses K1 and K2 of the flanges 1A and 2A. A fixing through hole 4*d* corresponding to the fixing through holes 1*d* and 2*d* is formed in three portions of the fixing cover 4.

The fixing cover 4 has been made of plastic (polypropylene) in the illustrated embodiment. It may be made of metal such as aluminum, stainless steel or the like, or hard rubber.

The exhaust pipe 1 and the sleeve 2 are fixed to the transom board 5 of the body A as follows. First of all, the sleeve 2 is inserted into the through hole 5*a* formed on the transom board 5 with the outer periphery thereof almost in contact with the inner peripheral edge of the through hole 5*a* and the flange 2A positioned on the outside of the body A. In this case, a packing 7 made of rubber having a thickness of about 1 mm (see FIG. 5(*d*)) is provided between a back face of the flange 2A of the sleeve 2 on the body side and the transom board 5 to seal between the transom board 5 and the flange 2A, as shown in FIG. 4. The packing 7 also has a through hole 7*g* formed in three portions corresponding to the fixing through holes 2*g*.

Next, a hole 5*g* corresponding to the fixing through hole 2*g* of the flange 2A is provided on the transom board 5 and a rivet 3 is inserted into the hole 5*g* through the fixing through hole 2*g* of the flange 2A. A tip of the rivet 3 is crushed on the inside of the body A (the inside of the transom board 5) and is fixed thereto.

The flange 1A of the exhaust pipe 1 is joined to the flange 2A with the projected portion 1*b* on the flange 1A of the exhaust pipe 1 housed in the annular groove 2*b* on the flange 2A of the sleeve 2. In addition, the fixing cover 4 is put on to cover the outer peripheral surfaces of the flanges 1A and 2A. In this state, the fixing cover 4 is fixed to the flanges 2A via the flanges 1A by using the fixing bolts 6. In the illustrated embodiment, a female screw thread is provided on an inner surface of the fixing through hole 2*d* as shown in FIG. 4. The fixing bolt 6 is tightened into the female screw thread.

The fixing bolt 6 is thus tightened so that the two flanges 1A and 2A are pressed and joined as shown in FIG. 4. As a result, the projected portion 1*b* of the flange 1A is pressed and deformed in the annular groove 2*b*. Consequently, a sealing state (watertight state) is formed in the connecting portion of the exhaust pipe 1 and the sleeve 2.

Each of structures of the exhaust pipe 1, the sleeve 2, the fixing cover 4 and the packing 7 is shown in an enlarged and exploded perspective view of FIG. 5. In FIG. 5, an arrow shown in a one-dotted dashed line indicates a fixing position of the rivet 3 or the bolt 6 and an inserting direction thereof.

As shown in FIGS. 1 and 2, the personal watercraft having the exhaust pipe 1 according to the illustrated embodiment is bullet-shaped as seen in a plane in FIG. 2. An opening 8 which is almost rectangular in a longitudinal direction of the body A is formed on an upper surface of a rear portion of the deck D, and a riding seat S is provided above the opening 8. A rider can sit on the seat S to operate a handlebar 21 provided ahead of the seat S, thereby steering the personal watercraft.

The engine E is disposed in a space, referred to as an "engine space" 20, surrounded by the hull T and the deck D which are provided below the seat S. In the illustrated embodiment, for example, the engine E is a two-cycle three-cylinder engine, and has a cylinder 10*a* mounted with a rightward inclination and has a crankshaft 10*b* mounted in the longitudinal direction of the body A. A carburetor 11 and an air cleaner 12 connected thereto are provided on the left of the engine E (on the left board, or port side, of the personal watercraft), and an assembled-type exhaust tube 13A is provided above the engine E. The exhaust tube 13A is connected to a muffler 14 provided in the obliquely left (port) and rear (aft) portion of the compartment for the engine E. The exhaust tube 13B is extended from the muffler 14, the sleeve 2 is fixed to a rear end of the exhaust tube 13B, and a front end of the exhaust pipe 1 is connected to a rear end of the sleeve 2 in a sealed manner as described above. The middle portion of the exhaust tube 13B is bent upward to provided a clearance and to keep away from a propulsion pump P. An output end of the crankshaft 10*b* projected from the rear portion of the engine E is connected to a shaft 15 of an impeller 16*b* of the propulsion pump P. The impeller 16*b* provided around the shaft 15 is covered with a casing 16*c* over the outer periphery, and pressurizes water taken from a water intake 17 provided on a bottom of the hull T by means of the propulsion pump P and ejects the water from an propulsion nozzle 18 provided in the rear portion, thereby giving rise to a propulsion force acting on the personal watercraft. If the handlebar 21 shown in FIG. 2 is operated right and left, a steering nozzle 19 provided behind the propulsion nozzle 18 is swung right and left, so that steering can be performed in a desired direction. A reverse deflector (not shown) is provided in the upper and rear portion of the steering nozzle 19 in such a manner that it can be swung downward around a horizontal swing shaft. The deflector is swung toward a lower position behind the steering nozzle 19 so that the water discharged from the steering nozzle 19 rearward is deflected forward. Thus, the personal watercraft can be caused to go astern. The reverse deflector is not shown to illustrate the exhaust pipe 1 clearly.

In FIG. 1, the reference numeral 9 denotes a rear deck. An openable hatch cover 29 is provided on the rear deck 9. In FIG. 1, the reference numeral 22 denotes a fuel tank for feeding a fuel to the engine E, and the reference numeral 23 denotes a front hatch cover. Another hatch cover 25 is provided in the two-layer form over the front hatch cover 23.

In FIG. 2, the reference numeral 26 denotes an igniter for supplying high-voltage electricity to an ignition plug 10*d*, and the reference numeral 27 denotes a battery.

In FIG. 3, the reference numeral 29 denotes a hook for pulling or the like, and the reference numeral 30 denotes a bilge exhaust port.

While the exhaust pipe 1 in the embodiment has been curved downward with a predetermined radius of curvature on the center in the longitudinal direction in the illustrated embodiment, the exhaust pipe itself may be rectilinearly inclined with a rear end (exhaust end) side placed down to obtain the opening face having the same angle in place of the above-mentioned structure. In such a case, exhaust pipe 1 of the invention can be carried out with a simple structure. In this case, furthermore, a rear bottom of the exhaust pipe may be cut with a plane which is almost parallel with the water surface.

Although the exhaust pipe has been formed separately from the exhaust tube in the above-mentioned embodiment, it will be apparent that the exhaust tube may be formed integrally with the exhaust pipe. While the sleeve 2 has been formed separately from the exhaust tube 13B in the above-mentioned embodiment, the sleeve 2 may be formed integrally with the rear end of the exhaust tube 13B.

Numerous modifications and alternative embodiments of the invention will be apparent to those skilled in the art in view of the foregoing description. Accordingly, this description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

We claim:

1. An exhaust pipe of a personal watercraft, comprising an exhaust pipe having an outlet opening formed on a rear end thereof, the outlet opening being positioned above a water surface and behind a transom board at least during planing of the personal watercraft to discharge an exhaust gas behind the personal watercraft, wherein the exhaust pipe is projected from the transom board rearward, at least a rear portion of a projected portion is curved obliquely downward, and an opening face of the outlet opening provided on the rear end of the exhaust pipe is turned obliquely rearward with respect to the water surface further comprising a connecting structure of the exhaust pipe, including:

a flange provided on a front end of the exhaust pipe;

a second exhaust pipe provided for leading an exhaust gas discharged from an engine to the transom board in a body of the watercraft, having a flange provided on a rear end of the second exhaust pipe configured for fixing the second exhaust pipe to a transom board and for being connected to the flange of the exhaust pipe, the flanges having fixing through holes formed correspondingly for connecting the flanges to each other;

an annular projected portion provided on an end face of one of the flanges for surrounding an exhaust gas passage hole in a central portion;

an annular groove is formed on an end face of the other flange for surrounding an exhaust gas passage hole in a central portion to house the projected portion therein; and the flange of the second exhaust pipe and the flange of the exhaust pipe being connected by a fasteners through the fixing through holes in such a manner that the annular projected portion is housed in the annular groove.

2. The exhaust pipe of a personal watercraft of claim 1, wherein one of the exhaust pipe and the second exhaust pipe is formed of a relatively more elastic material, and a connecting portion of the flange of the pipe which is formed of the relatively more elastic material is deformed to achieve a seal function in a state in which the connection is completed.

3. The exhaust pipe of a personal watercraft of claim 1, wherein the flange is non-circular as seen from a back of the watercraft.

4. The exhaust pipe of a personal watercraft of claim 1, further comprising a fixing cover, wherein a front face side of the flange of the second exhaust pipe is fixed to an external wall of the transom board with watertightness, and the flange of the exhaust pipe is fixed to that of the second exhaust pipe by fasteners extending through the fixing cover for covering an outer periphery of the flanges.

5. The exhaust pipe of a personal watercraft of claim 4, wherein the flange of the exhaust pipe and that of the second exhaust pipe are positioned by means of covering with the fixing cover over the outer periphery of the flanges.

6. An exhaust pipe of a personal watercraft, comprising an exhaust pipe outlet opening formed on a rear end thereof, the outlet opening being positioned above a water surface and behind a transom board at least during planing of the personal watercraft to discharge an exhaust gas behind the personal watercraft, wherein the exhaust pipe projects from the transom board rearward and has at least a curved pipe portion which is rearward of the transom board and is curved obliquely downward rearward of the transom boards and an opening face of the pipe outlet opening provided on the rear end of the exhaust pipe is turned obliquely rearward with respect to the water surface as seen from a side of the watercraft.

7. The exhaust pipe of a personal watercraft according to claim 6, wherein said opening face forms an angle ranging from about 10 degrees to about 60 degrees with respect to the water surface as seen from the side.

8. The exhaust pipe of a personal watercraft according to claim 6, wherein said opening face is turned to the water surface to form an angle ranging from about 25 degrees to about 45 degrees with respect to the water surface as seen from the side.

9. The exhaust pipe of a personal watercraft according to claim 6, wherein said opening face is turned obliquely to the water surface in such a manner that a projected area of the opening face onto a vertical virtual plane as seen from a rear side of the personal watercraft is about ½ of a cross-sectional area of said opening face at the rear portion of the exhaust pipe.

10. The exhaust pipe of a personal watercraft according to claim 6, wherein a distance between an upper end of said opening face and the water surface is substantially equal to a diameter of the opening face.

11. The exhaust pipe of a personal watercraft according to claim 10, wherein a height from a lower end of said opening face to the water surface is almost equal to a distance between the transom board and the lower end of the opening face.

12. The exhaust pipe of a personal watercraft according to claim 6, wherein said exhaust pipe is provided in a position deviated from a center line of a body toward one of sides, and said opening face is also inclined toward a side end of the one of sides with respect to a horizontal plane as seen from a rear side of the personal watercraft, and an inclination angle formed with respect to the horizontal plane ranges from about 5 degrees to about 35 degrees.

13. An exhaust pipe of a personal watercraft, comprising an opening face defining an outlet opening formed in a rear end of the exhaust pipe, the opening being positioned above a water surface and behind a transom board at least during planing of the watercraft to discharge an exhaust gas behind the personal watercraft, wherein the exhaust pipe is projected from the transom board rearward, and has a rear pipe portion which is curved obliquely downward rearward of the transom board, and said opening face provided on the rear end of the exhaust pipe is oriented obliquely rearward with respect to a extension line substantially extended rearward from the transom board over a planing surface of a bottom of the personal watercraft as seen from a side of the watercraft.

* * * * *